US010605019B2

(12) United States Patent
Zakharia et al.

(10) Patent No.: US 10,605,019 B2
(45) Date of Patent: Mar. 31, 2020

(54) SELF-LOCKING PACKER CARRIER

(71) Applicant: Dril-Quip, Inc., Houston, TX (US)

(72) Inventors: Steven M. Zakharia, Houston, TX (US); Frank D. Kalb, Cypress, TX (US); Curtis W. Payne, Richmond, TX (US)

(73) Assignee: Dril-Quip, Inc., Houston, TX (US)

( * ) Notice: Subject to any disclaimer, the term of this patent is extended or adjusted under 35 U.S.C. 154(b) by 134 days.

(21) Appl. No.: 15/933,679

(22) Filed: Mar. 23, 2018

(65) Prior Publication Data

US 2019/0292864 A1 Sep. 26, 2019

(51) Int. Cl.
*E21B 23/01* (2006.01)
*E21B 43/10* (2006.01)

(52) U.S. Cl.
CPC ..... *E21B 23/01* (2013.01); *E21B 43/105* (2013.01); *E21B 43/106* (2013.01); *E21B 43/108* (2013.01)

(58) Field of Classification Search
CPC .... E21B 23/01; E21B 43/1205; E21B 43/106; E21B 43/108; E21B 33/129; E21B 23/06
See application file for complete search history.

(56) References Cited

U.S. PATENT DOCUMENTS 6,666,276 B1 12/2003 Yokley et al.
7,096,938 B2 * 8/2006 Carmody ..... E21B 23/01 166/134
2003/0193145 A1 10/2003 Reimert et al.
2016/0032680 A1 2/2016 Krueger et al.
2017/0191342 A1 7/2017 Turley

FOREIGN PATENT DOCUMENTS

CN 201448083 U 5/2010

OTHER PUBLICATIONS

International Search Report and Written Opinion issued in PCT/US19/21744, dated Jul. 9, 2019, 14 pages.

* cited by examiner

*Primary Examiner* — Yong-Suk Ro
(74) *Attorney, Agent, or Firm* — Baker Botts L.L.P.

(57) ABSTRACT

A self-locking packer carrier includes an integrated locking mechanism that locks the packer carrier directly to the packer cone after the sealing element is fully set. The integrated locking mechanism may include one or more compression splines extending from a packer carrier base in a radially outward direction to engage a casing after the attached sealing element has created a fluid tight seal, and a tooth profile formed along an inner diameter of the packer carrier base to lock the packer carrier to the packer cone in response to a compression force transferred to the base via the splines. The integrated locking mechanism is designed to eliminate backlash on the liner hanger system, increase vibrational resistance, accommodate liner stretch, withstand pump-out loads, and tolerate liner movement while maintaining sealing integrity.

18 Claims, 3 Drawing Sheets

SELF-LOCKING PACKER CARRIER

TECHNICAL FIELD

The present disclosure relates generally to packer assemblies for use in liner hanger systems and, more particularly, to a packer assembly having a self-locking packer carrier.

BACKGROUND

When drilling a well, a borehole is typically drilled from the earth's surface to a selected depth and a string of casing is suspended and then cemented in place within the borehole. A drill bit is then passed through the initial cased borehole and is used to drill a smaller diameter borehole to an even greater depth. A smaller diameter casing is then suspended and cemented in place within the new borehole. This is repeated until a plurality of concentric casings are suspended and cemented within the well to a depth, which causes the well to extend through one or more hydrocarbon producing formations.

Rather than suspending a concentric casing from the bottom of the borehole to the surface, a liner is often suspended adjacent to the lower end of the previously suspended casing, or from a previously suspended and cemented liner, so as to extend the liner from the previously set casing or liner to the bottom of the new borehole. A liner is defined as casing that is not run to the surface. A liner hanger is used to suspend the liner within the lower end of the previously set casing or liner.

A running and setting tool disposed on the lower end of a work string may be releasably connected to the liner hanger, which is attached to the top of the liner. The work string lowers the liner hanger and liner into the open borehole until the liner hanger is adjacent the lower end of the previously set casing or liner, with the lower end of the liner typically slightly above the bottom of the open borehole. When the liner reaches the desired location relative to the bottom of the open borehole and the previously set casing or liner, a setting mechanism is conventionally actuated to move an anchoring element (e.g., slips) on the liner hanger from a compressed position to an expanded position and into engagement with the previously set casing or liner. Packer elements are also included in liner hanger systems to seal the annulus between the liner and the previously set casing. Such packer elements may be radially set by axial movement of the packer element relative to a conical wedge ring (or packer cone) on the liner hanger. An actuator on the liner hanger causes the packer element to move axially with respect to the conical wedge ring and thereby expand into sealing engagement with the casing surface to be sealed.

In conventional liner hanger systems, the packer is often located above the slips of the liner hanger. However, in such arrangements, the liner hanger body proximate the slips includes multiple grooves and slots that can weaken the mandrel and lead to lower burst and collapse ratings of the liner.

BRIEF DESCRIPTION OF THE DRAWINGS

For a more complete understanding of the present disclosure and its features and advantages, reference is now made to the following description, taken in conjunction with the accompanying drawings, in which.

DETAILED DESCRIPTION

Figure 1:
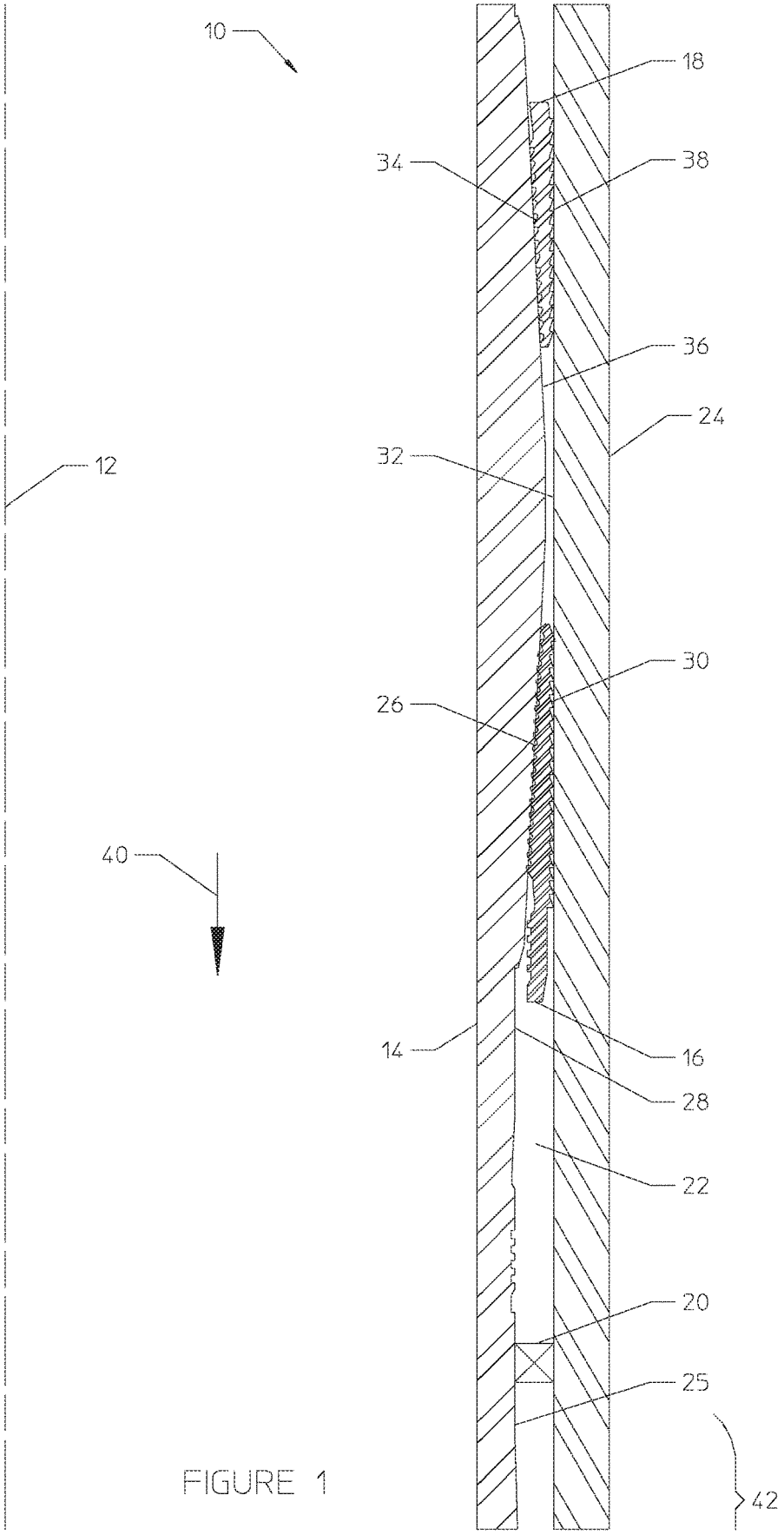
FIG. 1 is a cross sectional schematic view of a packer-down liner hanger assembly, in accordance with an embodiment of the present disclosure.

Illustrative embodiments of the present disclosure are described in detail herein. In the interest of clarity, not all features of an actual implementation are described in this specification. It will of course be appreciated that in the development of any such actual embodiment, numerous implementation specific decisions must be made to achieve developers' specific goals, such as compliance with system related and business related constraints, which will vary from one implementation to another. Moreover, it will be appreciated that such a development effort might be complex and time consuming, but would nevertheless be a routine undertaking for those of ordinary skill in the art having the benefit of the present disclosure. Furthermore, in no way should the following examples be read to limit, or define, the scope of the disclosure.

Certain embodiments according to the present disclosure may be directed to a self-locking packer carrier and a packer-down liner hanger system utilizing a self-locking packer carrier.

In liner hanger systems, a pair of slips (or single slip component) is used to set a liner hanger at an axial position within a casing, and a packer is used to seal the annular space between the liner hanger and the casing so as to isolate pressure within the annulus. In many conventional liner hanger systems, the packer is located above (uphole from) the slips. However, other liner hanger systems may feature a "packer-down" arrangement, in which the packer is located below (downhole from) the slips. Packer-down liner hanger systems may provide increased burst and collapse ratings of the liner hanger body below the packer element. This is because any slots and/or grooves present in the tubular body of the liner hanger are located proximate the slips, which are above the packer element. These slots and grooves decrease the thickness of the tubular body, thereby significantly reducing the pressure rating of the liner hanger at that position. By using a packer-down arrangement, the liner hanger body has an increased wall thickness at locations below the packer, thereby maximizing the burst and collapse rating of the liner hanger along the portions of the liner hanger body exposed to higher pressures.

The disclosed self-locking packer carrier may be particularly useful in a packer-down liner hanger system to maximize performance of the sealing element during various downhole processes. The self-locking packer carrier includes an integrated locking mechanism that locks the packer carrier directly to the packer cone after the sealing element is fully set. The integrated locking mechanism is designed to eliminate backlash on the liner hanger system, increase vibrational resistance, accommodate liner stretch, withstand pump-out loads, and tolerate liner movement while maintaining sealing integrity.

It should be noted that, while the disclosed self-locking packer carrier is described with reference to use in a packer-down liner hanger, it can also be used in various other applications where a superior locking mechanism is desired, such as a conventional liner hanger.

Turning now to the drawings, FIG. 1 is a schematic cross-sectional view of a liner hanger system 10 in which the disclosed self-locking packer carrier may be utilized. The illustrated cross section only shows the liner hanger system 10 on one side of a longitudinal axis 12. It will be understood that the liner hanger system 10 and its constituent parts are generally tubular and therefore extend all the way around the axis 12.

In general, the liner hanger system 10 may include a liner hanger 14, lower slips 16, upper slips 18, and a packer assembly 20. The packer assembly 20 may include a self-locking packer carrier along with a packer seal that seals an annulus 22 between the liner hanger 14 and a casing 24. The packer assembly 20 may be set and energized against a packer cone 25 of the liner hanger 14. As shown, the packer cone 25 may include a frustoconical surface that slopes radially outward in a downhole direction. The packer cone 25 may be integral with a main body of the liner hanger 14 or may be a separate component coupled to the main body of the liner hanger 14. The packer assembly 20 will be described in greater detail below with reference to FIGS. 2 and 3.

The lower slips 16 may be set in the annulus 22 between the liner hanger 14 and the casing 24 to prevent the liner hanger 14 from moving axially downward relative to the casing 24. The lower slips 16 may include one or more frustoconical inner walls 26. The frustoconical inner wall(s) 26 of the lower slips 16 slant radially inward in a downhole direction to engage one or more complementary frustoconical surfaces 28 on the liner hanger 14. The frustoconical inner wall(s) 26 of the lower slips 16 may include teeth formed therein. The complementary frustoconical surface(s) 28 of the liner hanger 10 may be integral with a main liner hanger body or may be coupled to the outside of the main liner hanger body. The lower slips 16 may include an outer wall 30 with teeth formed therein to grip an internal surface 32 of the casing 24. The frustoconical inner wall(s) 26 and teeth on the lower slips 16 are oriented such that the lower slips 16, once set between the frustoconical surface(s) 28 of the liner hanger 10 and the internal surface 32 of the casing 24, prevents the liner hanger 14 from moving axially downward relative to the casing 24.

The upper slips 18 may be set in the annulus 22 between the liner hanger 14 and the casing 24 to prevent the liner hanger 14 from moving axially upward relative to the casing 24. The upper slips 18 may include one or more frustoconical inner walls 34. The frustoconical inner wall(s) 34 of the upper slips 18 slant radially outward in a downhole direction to engage one or more complementary frustoconical surfaces 36 on the liner hanger 14. The frustoconical inner wall(s) 34 of the upper slips 18 may include teeth formed therein. The complementary frustoconical surface(s) 36 of the liner hanger 10 may be integral with a main liner hanger body or may be coupled to the outside of the main liner hanger body. The upper slips 18 may include an outer wall 38 with teeth formed therein to grip the internal surface 32 of the casing 24. The frustoconical inner wall(s) 34 and teeth on the upper slips 18 are oriented such that the upper slips 18, once set between the frustoconical surface(s) 36 of the liner hanger 10 and the internal surface 32 of the casing 24, prevents the liner hanger 14 from moving axially upward relative to the casing 24.

It should be noted that although the lower slips 16 and upper slips 18 are illustrated and described as acting separately within the liner hanger system 10, these slips 16 and 18 may also be combined into a single bi-directional slip assembly. In such an embodiment, the lower slips 16 and the upper slips 18 of the bi-direction slip assembly may be set via the same actuation process.

The illustrated liner hanger system 10 is a packer-down liner hanger system. This means that the liner hanger system 10 is arranged such that the packer assembly 20 is located downhole (direction 40) from both the lower slips 16 and the upper slips 18. Portions of the liner hanger 14 that are designed to engage with the lower and upper slips 16 and 18 (e.g., liner hanger body and/or frustoconical surfaces 28 and 36) generally include slots or grooves formed therein, which can weaken the liner hanger 14. The liner hanger 14 cannot withstand as high pressures acting on these thinner sections. By positioning the packer assembly 20 below these thinner portions of the liner hanger 14, a portion (42) of the liner hanger 14 located below the packer assembly 20 may be rated for higher annulus pressures than would be possible if the lower and upper slips 16 and 18 were positioned below the packer assembly 20, since this portion 42 does not feature slots or grooves.

The packer-down configuration of the liner hanger system 10 allows for most of the body of the liner hanger 14 to be pressure equalized in the area above the packer assembly 20 where slots and grooves are present for the lower and upper slips 16 and 18. The liner hanger system 10 features a maximum amount of body wall thickness of the liner hanger 14 at and below the packer assembly 20 (section 42), thereby resulting in higher system ratings. The self-locking packer carrier and packer assembly 20 disclosed herein may be particularly useful within liner hanger systems 10 arranged in a packer-down configuration as shown in FIG. 1. However, it should be noted that the disclosed self-locking packer carrier may be similarly used to establish an annular seal in other configurations of liner hanger assemblies, such as conventional liner hangers having the packer positioned above the slips.

Figure 2:
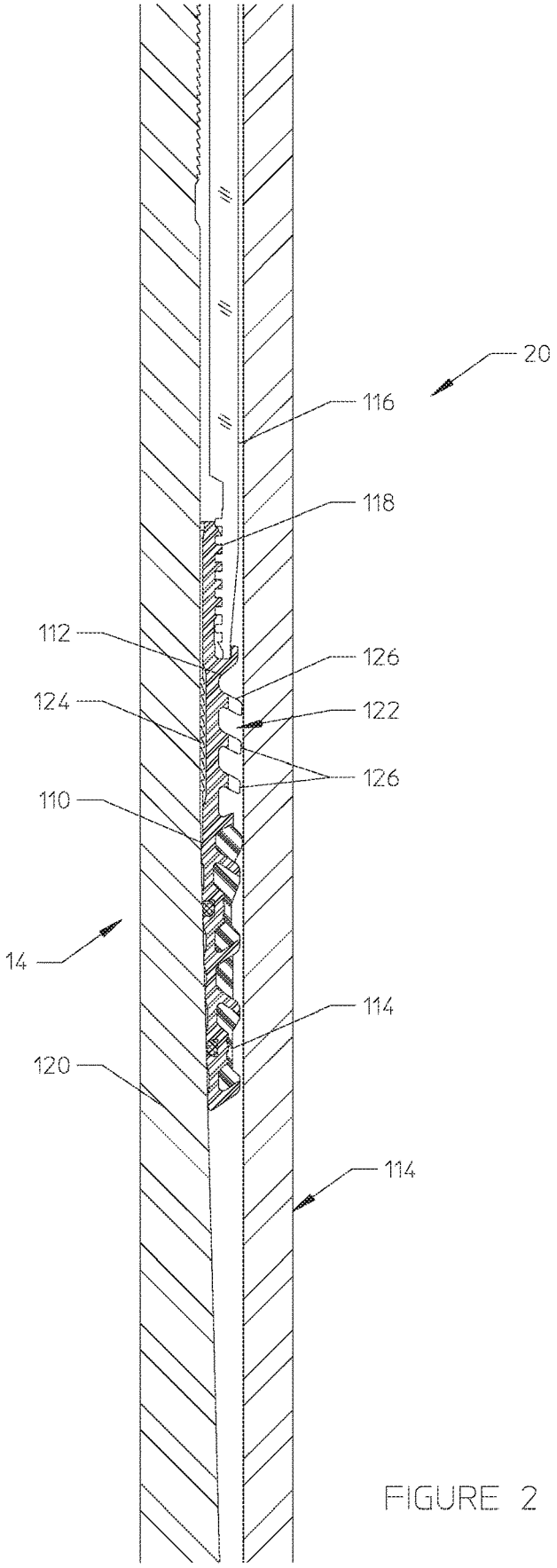
FIG. 2 is a cutaway view of a packer assembly having a self-locking packer carrier being used in a liner hanger assembly, in accordance with an embodiment of the present disclosure.

FIG. 2 illustrates the packer assembly 20 located between the liner hanger 14 and the casing 24 in greater detail. The packer assembly 20 may include an annular packer element 110, and the annular packer element 110 may include both a packer carrier 112 and a packer sealing element 114. As shown, at least a portion of the sealing element 114 may be formed integral with the packer carrier 112. In accordance with disclosed embodiments, the packer carrier 112 comprises a self-locking packer carrier.

As shown, the annular packer element 110 may be positioned at the lower (downhole) end of a packer sleeve 116, which may be positioned at the lower (downhole) end of a tie-back receptacle (not shown) prior to the packer element 110 being brought into sealing engagement with the casing 24. Grooves or threads 118 or similar connectors may be used to interconnect the packer element 110 to the packer sleeve 116. Axial movement of the packer sleeve 116 and thus the packer element 110 in response to the packer setting operation pushes the packer element 110 downward relative to the tapered packer cone 25 to expand the sealing element 114 into sealing engagement with the casing 24. As shown, the tapered packer cone 25 may be supported on a liner hanger body 120 of the liner hanger 14. In an environment where the packer element 110 is not the top liner hanger seal, the packer element 110 may be supported on the end of a seal actuator which replaces the illustrated packer sleeve 116, and the liner hanger body 120 may be a packer mandrel or other conveyance tubular for positioning the packer element 110 at a selected position within the wellbore.

The packer sleeve 116 of the tie back receptacle shown in FIG. 2 represents a lower portion of an actuator sleeve, which urges the packer element 110 from a reduced diameter run-in position to an expanded diameter activated or sealed position. The downhole force from the actuator sleeve may also cause the self-locking packer carrier 112 to lock the packer element 110 against the packer cone 25. The actuator sleeve may thus apply a selected axial force to the packer element 110 to set the packer assembly 20. The actuator may be selectively activated by various mechanisms, including set down weight or other manipulation of the conveyance tubular, and may include axial movement of a piston in response to fluid pressure, either with or without dropping plugs or balls to increase fluid pressure.

The packer element 110 as shown in FIG. 2 is in its original configuration in which the outer diameter of the packer element 110 is reduced prior to being sealed with the casing 24. The packer element 110 is expandable so that it is moved downwardly over the stationary packer cone 25 to seal against the casing 24. The packer element 110 may be moved into reliable sealing engagement with the casing 24 by a setting operation, which includes moving the packer element 110 axially with respect to the packer cone 25, rather than moving the cone with respect to the stationary packer element. This setting operation forms a reliable seal with the casing 24 by allowing ribs on the sealing element 114 to flex or deform into the shape of the casing 24 during the setting operation.

As mentioned above, the packer element 110 includes both the sealing element 114 and a self-locking packer carrier 112. The sealing element 114 generates a high-pressure seal between the liner hanger 14 and the casing 24 upon setting of the seal. The self-locking packer carrier 112 includes a locking mechanism 122 that locks the packer element 110 to the packer cone 25 after the sealing element 114 has been properly set at the desired location. The packer carrier 112 may also include the grooves or threads 118 or other connector used to connect the packer element 110 to an actuation sleeve. Only after the sealing element 114 is engaged and sealing against the casing 24 does the locking mechanism 122 activate to lock the packer carrier 112 (and thus the connected sealing element 114) to the packer cone 25. The locking mechanism 122 may include a hardened tooth profile 124 at a radially inner surface of the packer carrier 112, along with one or more compression splines 126 extending from a radially outer surface of the packer carrier 112. The hardened tooth profile 124 may be compressed into the packer cone 25 via the outer diameter compression splines 126.

Figure 3:
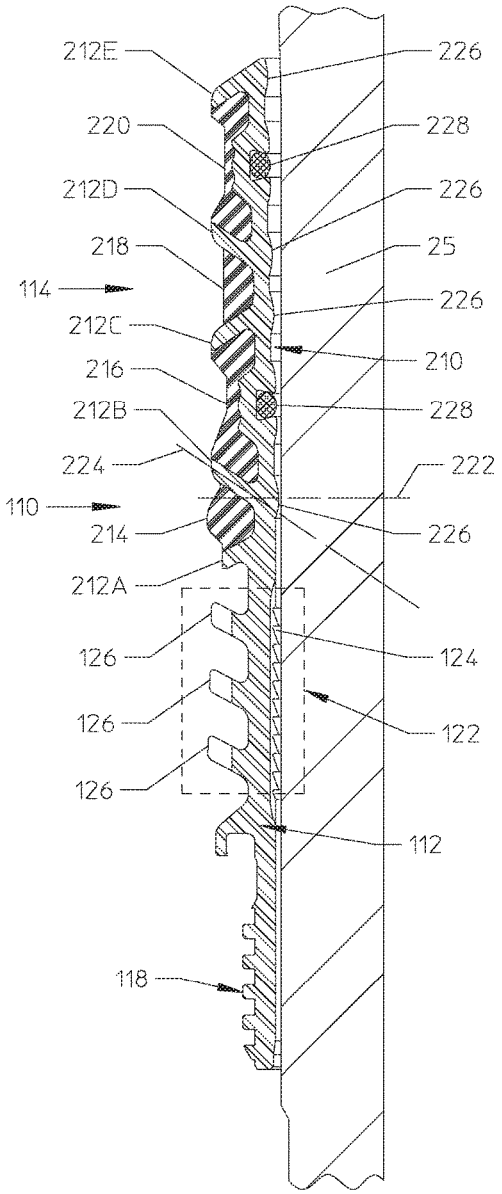
FIG. 3 is a cutaway view of a packer element having a self-locking packer carrier, in accordance with an embodiment of the present disclosure.

FIG. 3 (with an expanded view in FIG. 3A) illustrates more clearly the overall packer element 110, the self-locking packer carrier 112, and the locking mechanism 122. The packer element 110 is shown positioned against the packer cone 25. The packer element 110 includes the sealing element 114 as mentioned above. The sealing element 114 may include a radially inner metal base 210 designed to slide over the packer cone 25 and annular flanges or ribs 212 that extend radially outwardly from the base 210. The base 210 is cylindrical in shape and may be relatively thin to facilitate radial expansion. The base 210 and the ribs 212 generally form a metal framework that supports seal bodies made from rubber or another resilient/elastomeric material. In the illustrated embodiment, the sealing element 114 includes seal bodies 214, 216, 218, and 220 provided between the ribs 212, such that the upper and lower sides of each seal body are in engagement with a respective rib 212. It should be noted that the illustrated arrangement of ribs 212 and seal bodies 214, 216, 218, and 220 is merely representative; the sealing element 114 may include different numbers of ribs and seal bodies depending on the sealing needs and materials of the assembly.

The base 210 and ribs 212 are formed from material having sufficient ductility to expand into the annulus between the casing and the liner hanger. The metal portion of the packer element 110, namely the base 210, ribs 212, and self-locking packer carrier 112 may be formed from material that is relatively soft compared to metals commonly associated with downhole tools. This allows the packer element 110 to reliably expand into sealing engagement with the casing at a reduced setting load.

The radially projecting ribs 212 of the sealing element 114 may each be substantially angled with respect to a plane perpendicular to a longitudinal axis of the packer element 110. For example, the centerline of each rib 212 may be angled in excess of 15 degrees, or even 30 degrees, relative to a plane 222 perpendicular to the longitudinal axis of the packer element 110. Although the ribs 212 may be slightly tapered to become thinner moving radially outward, the ribs 212 may have a substantially uniform axial thickness. The rib 212B is shown in FIG. 3 at an angle 224 between the rib centerline and the plane 222. This feature may allow each of the ribs 212 to expand substantially as the diameter of the casing varies or "grows", whether in response to internal pressure and/or thermal expansion. Because of the ability of the angled ribs 212 to flex, reliable metal-to-metal contact may be maintained between the ends of the ribs 212 and the casing (not shown).

The base 210 of the sealing element 114 may include a plurality of inwardly projecting protrusions 226. These protrusions 226 or beads on the sealing element 114 may provide a reliable metal-to-metal sealing engagement with the packer cone 25. These protrusions 226 provide high stress points to form a reliable metal-to-metal seal. The metal-to-metal seal between the base 210 of the sealing element 114 and the tapered packer cone 24 may be energized as the packer seal is set, and may include multiple redundant annular metal-to-metal seals.

The sealing element 114 may include one or more resilient elastomeric seals 228 on the radially inner diameter of the seal base 210. These elastomeric seals 228 may function as backup seals, since the spaced apart metal protrusions 226 form the metal-to-metal seal between the sealing element 114 and the cone 25 once the sealing element 114 is fully set.

With the desired setting force applied to the sealing element 114, the sealing element 114 will be pushed down the ramp of the cone 25 so that the ribs 212 come into metal-to-metal engagement with the casing (not shown). The metal seal protrusions 226 between the sealing element 114 and the packing cone 25 may be in contact at this point, but not energized. When the setting pressure is increased, the ribs 212 on the sealing element 114 may be flexed inward as they are pulled against the casing. The high setting force will compress the seal bodies 214, 216, 218, and 220 between the ribs 212 and cause the outer diameter of each seal body into tight sealing engagement with the casing. This high setting force will also cause the metal protrusions 226 along the inner diameter of the seal element 114 to form a reliable metal-to-metal seal with the packer cone 25. Under this load, the metal protrusions 226 form high-localized stress at the points where the protrusions 226 engage the cone 25 to achieve a reliable metal-to-metal seal. A reliable fluid pressure tight barrier, which may be both a liquid barrier and a gas barrier, is thus formed with high reliability under various temperatures, pressures and sealing longevity conditions, due to the combination of the elastomeric and metal seals.

Having described the sealing element portion 114 of the packer element 110, a more detailed description of the disclosed self-locking packer carrier 112 will now be provided. As mentioned above, the locking mechanism 122 of the packer carrier 112 includes outer diameter compression splines 126 and a tooth profile 124 formed along the inner diameter of a cylindrical metal base of the packer carrier 112. As shown, the base of the packer carrier may be the same as, an extension of, or integral with the metal base 210 of the packer-sealing element 114.

The self-locking packer carrier 112 includes the radially inner tooth profile 124 formed along the metal base 210 and designed to grip the packer cone 25 after the sealing element 114 has been energized. The self-locking packer carrier 112 also includes annular compression splines 126 that extend radially outward from the base 210. The compression splines 126 generally extend the metal framework of the base 210 outward to interact directly with the casing (not shown). The compression splines 126 are designed to directly contact the casing only after the ribs 212 and protrusions 226 of the sealing element 114 have sufficient contact pressure against the casing and packer cone 25, respectively, to maintain a seal within the annulus. The contact of the compression splines 126 against the casing may cause the compression splines 126 to toggle a strut-like radial compressive load that forces the inner tooth profile 124 of the packer carrier 112 to lock into the packer cone 25.

It should be noted that the illustrated arrangement of the compression splines 126 is merely representative; the self-locking packer carrier 112 may include different numbers (e.g., 1, 2, 4, 5, 6, 7, 8, or more) of compression splines 126 depending on the sealing needs and materials of the assembly.

Figure 3A:
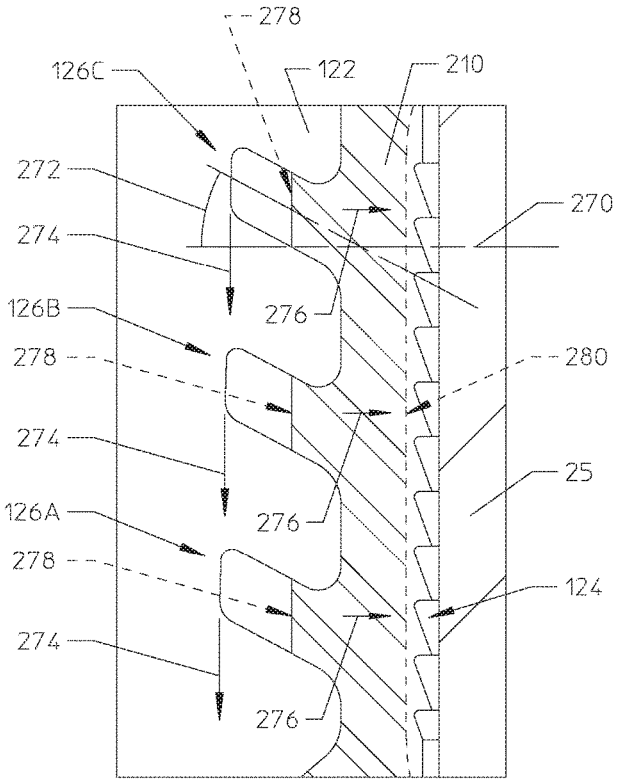
FIG. 3A is a close up cutaway view of the self-locking packer carrier of FIG. 3, in accordance with an embodiment of the present disclosure.

The compression splines 126 of the packer carrier 112 may each be substantially angled with respect to a plane perpendicular to a longitudinal axis of the packer element 110. For example, the centerline of each compression spline 126 may be angled in excess of 15 degrees, or even 30 degrees, relative to a plane 270 perpendicular to the longitudinal axis of the packer element 110. Specifically, each of the compression splines 126 may be angled such that they slant in a downhole direction as they extend outward from the base of the packer carrier 112. The compression spline 126C is shown in FIG. 3A at an angle 272 between the spline centerline and the plane 270. Although the compression splines 126 may be slightly tapered to become thinner moving radially outward, the compression splines 126 may have a substantially uniform axial thickness.

In some embodiments, the compression splines 126 may extend radially outward a further distance from the base 210 than the ribs 212 of the sealing element 114 extend. In addition to or in lieu of this increased radial extension, the width of the compression splines 126 may be generally thicker than that of the ribs 212, and the overall thickness of the base 210 at the axial location of the packer carrier 112 may be generally greater than the overall thickness of the base 210 at the axial location of the sealing element 114. All of these features, alone or in combination, may increase the rigidity of the compression splines 126 compared to the ribs 212 which are designed to flex into sealing engagement with the casing.

As the setting force is applied to the sealing element 114, the packer carrier 112 will be pushed down the ramp of the packer cone 25 with the attached sealing element 114. As discussed above, this setting force acts to set the sealing element 114 within the annulus forming a fluid pressure tight barrier via the ribs 212, seal bodies 214, 216, 218, and 220, and protrusions 226. Upon setting of the sealing element 114, the downward setting force applied to the packer carrier 112 may cause the compression splines 126 to be brought into contact with the casing (not shown). Upon loading, the compression splines 126 may be thrust against the inner surface of the casing. Since the splines 126 are relatively thick, they do not collapse into further engagement with the wall of the casing as the ribs 212 of the sealing element 114 do. Instead, the distal ends of the compression splines 126 are toggled in an upward direction via the reactive force from the casing acting on the splines 126 in an uphole direction (arrows 274). This movement of the compression splines 126 causes the splines to flex in the uphole direction, from their original downward slanted orientation to one that is closer in orientation to the perpendicular plane 270. As the packer carrier 112 is relatively rigid, this movement of the strut-like compression splines 126 generates a radially compressive force (arrows 276) through the base 210 and toward the inner diameter of the base 210. This compressive force ultimately compresses the tooth profile 124 into locking engagement with the packer cone 25. As such, applying the setting force to the packer carrier 112 and attached sealing element 114 effectively locks the packer carrier 112 against the packer cone 25 after activating the fluid tight annular seal via the sealing element 114.

The inner diameter tooth profile 124 on the packer carrier base may include rows of hardened teeth to ensure their capability to bite into and lock against the packer cone 25. The teeth of the tooth profile 124 may be oriented on an incline, as shown, such that the packer carrier 112 is more easily able to move downhole relative to the packer cone 25 than uphole relative to the packer cone 25. That is, the tooth profile 124 is able to grip the packer cone 25 as the packer carrier 112 moves against the packer cone 25 in one axial direction and slips past the packer cone 25 as it moves along the packer cone 25 in an opposite axial direction. The slanted orientation of the tooth profile 124 is particularly useful as it does not hinder the ability of the packer carrier 112 to travel along the packer cone 25 during setting of the sealing element 114. However, once the sealing element 114 is set and the tooth profile 124 of the packer carrier 112 is locked into place, the packer cone 25 and packer carrier 112 will be conjoined to one another preventing all relative motion between the packer cone 25 and the packer carrier 112/sealing element 114.

One or both of the outer diameter compression splines 126 and the inner diameter tooth profile 124 of the packer carrier 112 may have slots 278 and 280, respectively, formed therein. Such slots 278 and 280 may be oriented in an axial direction (i.e., parallel to the axis of the packer element 110). The slots 278 and 280 are illustrated in FIGS. 3 and 3A via dashed lines extending through these portions of the packer carrier 112. The compression splines 126 may include a set of multiple slots 278 formed therethrough that are circumferentially spaced from each other about the axis of the packer element 110. The tooth profile 124 may also include a set of multiple slots 280 formed therethrough that are circumferentially spaced from each other about the axis of the packer element 110. The slots 278 and 280 formed through the compression splines 126 and the tooth profile 124 may reduce the force required to expand the sealing element 114 into sealing engagement between the packer cone 25 and the casing. The slots 278 and 280 may also ensure that no trapped pressure pockets are created during setting of the packer element 110. This will allow the sealing element 114 to remain energized during downhole operations.

Locking the packer carrier 112 directly to the packer cone 25 via the locking mechanism 122 described herein helps to eliminate backlash within the packer system while locking the packer to the cone 25. The locking mechanism 122 allows the metal-to-metal sealing element 114 to travel all the way along the packer cone 25 until a final sealing destination is reached. The disclosed locking mechanism 122 does not interrupt or change this sealing position while the packer carrier 112 is being locked to the cone 25 since it does not rely on an independent locking mechanism (such as a lock ring) with an independent tolerance stack-up. The locking mechanism 122 locking the sealing element 114 to the packer cone 25 may also increase the capability of the system to withstand pump-out pressures.

The disclosed self-locking packer carrier 112 may increase the vibrational resistance of the packer element 110 by locking the sealing element 114 relative to the packer cone 25. This increase in vibrational resistance is important for maintaining downhole seals as they are regularly subjected to oscillatory motion as part of day-to-day downhole operations, such as drilling, producing, fracking, etc.

The disclosed locking mechanism 122 also enables the packer carrier 112 and the packer cone 25 to move as a single unit. Longer casing lengths, heavier weights, and higher downhole temperatures have increased the amount of stretch that a liner hanger body may be subjected to. In packer-down liner hangers, this stretch will be transferred through the portion of the liner hanger system adjacent to the packer assembly 20, since there are not slips located just below the packer assembly 20 to keep this portion of the liner hanger from moving. Conjoining the packer carrier 112 to the packer cone 25 via the integrated locking mechanism 122 may prevent any separation between the two components (packer carrier 112 and cone 25) while allowing for relative motion between the packer seal and the host casing. This will enable the system to tolerate axial motion while maintaining sealing integrity in packer-down liner hanger configurations.

As discussed at length above, the disclosed system includes a self-locking packer carrier 112, which may be particularly useful in a packer-down liner hanger assembly, for example as shown in FIG. 1. The packer-down liner hanger system 10 allows for the lower slips 16, the upper slips 18, and all their supporting features to be placed above the packer carrier where the system is pressure equalized. Furthermore, this allows for the maximum amount of body wall thickness at and below the packer assembly 20, thereby resulting in higher system ratings. Turning back to FIG. 3, the self-locking packer carrier includes an integrated locking mechanism 122 that features outer diameter compression splines 126 that are used to transmit a radial load to the inner diameter hardened teeth profile 124 for the purpose of mechanically locking the packer carrier 112 to the packer cone 25 after the sealing element 114 has been set with sufficient contact pressure to form a fluid tight seal. The self-locking packer carrier 112, when used in conjunction with a packer-down liner hanger system (e.g., 10 of FIG. 1), may provide a system that has both the seal reliability of a conventional liner hanger as well as the high pressure ratings of an expandable liner hanger.

Although the present disclosure and its advantages have been described in detail, it should be understood that various changes, substitutions and alterations can be made herein without departing from the spirit and scope of the disclosure as defined by the following claims.

What is claimed is:

1. A self-locking packer assembly, comprising:

a sealing element for sealing an annular space between a packer cone and an outer tubular;

a packer carrier coupled to the sealing element, wherein the packer carrier comprises:

a cylindrical base;

one or more compression splines extending radially outward from an outer diameter of the cylindrical base; and a tooth profile formed along an inner diameter of the cylindrical base for locking the packer carrier to the packer cone.

2. The self-locking packer assembly of claim 1, wherein the one or more compression splines each extend radially outward from the cylindrical base at an angle relative to a plane perpendicular to a longitudinal axis of the packer carrier.

3. The self-locking packer assembly of claim 2, wherein the angle is greater than approximately 15 degrees oriented in a downhole direction relative to the plane perpendicular to the longitudinal axis.

4. The self-locking packer assembly of claim 1, wherein the one or more compression splines are configured to move from a first orientation relative to a longitudinal axis of the packer carrier to a second orientation in response to a contact force from the outer tubular, wherein this movement of the compression splines transmits a compressive force through the cylindrical base that pushes the tooth profile into locking engagement with the packer cone.

5. The self-locking packer assembly of claim 1, wherein the sealing element comprises a metal frame that is integral with the cylindrical base of the packer carrier.

6. The self-locking packer assembly of claim 1, wherein the sealing element comprises:

a cylindrical base;

a plurality of ribs extending radially outward from the an outer diameter of the cylindrical base;

one or more elastomeric seal bodies disposed between adjacent ribs; and a plurality of protrusions projecting radially inward from an inner diameter of the cylindrical base.

7. The self-locking packer assembly of claim 6, wherein the one or more compression splines each have a thicker axial cross section than the ribs of the sealing element.

8. The self-locking packer assembly of claim 1, wherein the tooth profile comprises a plurality of hardened teeth.

9. The self-locking packer assembly of claim 1, wherein the tooth profile comprises a plurality of teeth that are oriented on an incline such that the tooth profile grips the packer cone is one axial direction and slips past the packer cone in an opposite axial direction.

10. The self-locking packer assembly of claim 1, wherein one or more slots are formed in an axial direction through the compression splines, the tooth profile, or both.

11. A system comprising:

a liner hanger system with a packer cone;

lower slips disposed in an annulus between the liner hanger system and a casing to prevent the liner hanger system from moving axially downward relative to the casing;

upper slips disposed in the annulus between the liner hanger system and the casing to prevent the liner hanger system from moving axially upward relative to the casing; and a packer assembly for sealing between the packer cone and the casing, wherein the packer assembly comprises:

a sealing element that generates a fluid tight seal between the packer cone and the casing; and a self-locking packer carrier coupled to the sealing element, wherein the packer carrier comprises a locking mechanism that locks the packer carrier and the sealing element in a position relative to the packer cone after the sealing element generates the seal, wherein the locking mechanism comprises:

one or more compression splines extending radially outward from an outer diameter of a cylindrical base of the packer carrier; and a tooth profile formed along an inner diameter of the cylindrical base for locking the packer carrier directly to the packer cone.

12. The system of claim 11, wherein the one or more compression splines are configured to move from a first orientation relative to a longitudinal axis of the packer carrier to a second orientation in response to a contact force from the casing, wherein this movement of the compression splines transmits a compressive force through the cylindrical base that pushes the tooth profile into locking engagement with the packer cone.

13. The system of claim 11, wherein one or more slots are formed in an axial direction through the compression splines, the tooth profile, or both.

14. The system of claim 11, wherein the sealing element comprises:

a cylindrical base;

a plurality of ribs extending radially outward from an outer diameter of the cylindrical base;

one or more elastomeric seal bodies disposed between adjacent ribs; and a plurality of protrusions projecting radially inward from an inner diameter of the cylindrical base.

15. A method, comprising:

applying a setting force to a packer assembly comprising a sealing element and a self-locking packer carrier;

lowering the packer assembly down a packer cone in response to the setting force;

generating a fluid tight seal between the packer cone and an outer tubular via the sealing element in response to the setting force; and locking the packer carrier to the packer cone via a locking mechanism of the packer carrier in response to the setting force, after generating the fluid tight seal, wherein locking the packer carrier to the packer cone comprises:

contacting one or more compression splines extending radially outward from the packer carrier via the outer tubular as the packer carrier moves down the packer cone;

moving the one or more compression splines from a first orientation relative to a plane perpendicular to a longitudinal axis of the packer carrier to a second orientation;

transmitting a radially compressive force from the compression splines through the packer carrier; and gripping the packer cone via a tooth profile disposed on an inner diameter of the packer carrier in response to the compressive force.

16. The method of claim 15, further comprising preventing pressure from becoming trapped within the packer assembly during locking of the packer carrier via slots formed through the compression splines, the tooth profile, or both.

17. The method of claim 15, further comprising maintaining the sealing element in position relative to the packer cone as a liner hanger having the packer cone moves relative to the outer tubular.

18. The method of claim 15, further comprising setting lower slips and upper slips of a liner hanger system having the packer cone to prevent the liner hanger system from moving downward and upward, respectively, relative to the outer tubular, wherein the packer assembly is located axially downhole from the lower and upper slips.

* * * * *